US006293443B1

(12) United States Patent
Nykoluk

(10) Patent No.: US 6,293,443 B1
(45) Date of Patent: Sep. 25, 2001

(54) FOLDABLE GARMENT HANGER FOR COMPACTLY STORING GARMENTS WHEN TRAVELING

(75) Inventor: Cory O. Nykoluk, St. Louis, MO (US)

(73) Assignee: TRG Accessories, LLC, St. Louis, MO (US)

( * ) Notice: Subject to any disclaimer, the term of this patent is extended or adjusted under 35 U.S.C. 154(b) by 0 days.

(21) Appl. No.: 09/605,321

(22) Filed: Jun. 28, 2000

(51) Int. Cl.[7] ..... A47G 25/40
(52) U.S. Cl. ..... 223/94; 223/89
(58) Field of Search ..... 223/94, 89, 85, 223/88, 92

(56) References Cited

U.S. PATENT DOCUMENTS

| | | | | |
|---|---|---|---|---|
| 952,202 | * | 3/1910 | Kligenfeld | 223/94 |
| 2,424,527 | * | 8/1947 | Gaudino | 223/94 |
| 4,186,858 | | 2/1980 | Tatematsu . | |
| 4,669,642 | * | 6/1987 | Nicholas | 223/94 |
| 4,717,053 | | 1/1988 | Wang . | |
| 5,383,584 | | 1/1995 | Adams . | |
| 5,622,255 | * | 4/1997 | Riccoboni | 223/94 |
| 5,749,505 | | 5/1998 | Reyes . | |
| 5,813,578 | | 9/1998 | Hsieh . | |
| 5,893,493 | | 4/1999 | Noiray . | |
| 5,979,721 | | 11/1999 | Curtis . | |

* cited by examiner

*Primary Examiner*—Bibhu Mohanty
(74) *Attorney, Agent, or Firm*—Howell & Haferkamp LC

(57) ABSTRACT

A foldable garment hanger has shoulder support members that can be folded together while supporting a garment thereon. The foldable hanger allows the garment to be quickly folded in half about the centerline of the backside of the garment where the garment can then be folded horizontally one or more times so as to fit into a conventional carry-on baggage. The foldable hanger is further provided with a hook configured such that a traveler can unpack and unfold the garment by simply hanging the foldable hanger on a conventional hanger rod or hook and unfolding the shoulder support members of the invention. When unfolded, the invention can be used in a manner similar to a conventional garment hanger.

17 Claims, 5 Drawing Sheets

FOLDABLE GARMENT HANGER FOR COMPACTLY STORING GARMENTS WHEN TRAVELING

BACKGROUND OF THE INVENTION (1) Field of the Invention

This invention pertains to the field of garment hangers. More particularly, this invention pertains to a foldable hanger that allows a garment to be folded in half along the centerline of the backside of the garment for transporting the garment in a compact luggage piece when travelling. When removed from the luggage piece, the hanger can be unfolded and used to support the garment on a standard hanger rod or pole in a manner similar to a conventional hanger.

(2) Description of the Related Art

Travelers often desire to travel light, carrying with them as few pieces of luggage as possible. It is also desirable for travelers on airplanes to avoid delays associated with checking-in luggage before their flight and retrieving luggage after their flight by stowing their items in the carry-on luggage.

In addition to carrying standard luggage, business travelers are often burdened with the additional need to carry a separate garment bag to transport easily wrinkled items of clothing, such as suits. Such garment bags pose numerous disadvantages for travelers attempting to travel light and avoid delays. One such disadvantage is that garment bags are usually relatively large since they are designed to hold garments generally unfolded. Thus, when attempting to use a garment bag as carry-on luggage while traveling on an airplane, it is often necessary to forcibly compact the garment bag into an overhead compartment. However, compacting the garment bags in this manner has a tendency to wrinkle the garments being transported. Furthermore, airlines are increasingly placing restrictions on the allowable size of carry-on luggage, thereby requiring passengers to check-in larger pieces luggage such as garment bags, which inevitably causes delays for many travelers. Another disadvantage associated with conventional garment bags is that they are typically non-rigid and therefore unsuited for being provided with towing wheels as have become increasing desirable to travelers. Thus, garment bags are often burdensome since travelers can not tow such luggage, but rather must carry the luggage by hand or support the luggage on their shoulder.

As an alternative to using a garment bag, some travelers prefer to fold their garments in a manner suitable for stowing in a conventional piece of carry-on luggage. However, it is often difficult to fold garments, such as suits, in a manner that prevents wrinkling. Additionally, it is often burdensome for travelers to remove the garments from the luggage and place those garments back on hangers when the traveler reaches his or her destination.

The present invention overcomes the disadvantages of prior art devices used to transport garments by providing a foldable hanger that allows various garments such as suits, shirts, and blouses to be quickly folded into a compact dimension small enough to be transported securely in a standard piece of carry-on luggage. Thus, no additional burdensome garment bag is needed for traveling. The foldable hanger of this invention also allows a traveler to quickly unpack such garments by simply hanging the invention on a conventional hanger rack or rod and unfolding the hanger.

SUMMARY OF THE INVENTION

The foldable hanger of the present invention is configured to support a typical garment in a conventional manner on shoulder support members and to quickly allow the garment to be folded in half along the centerline of its backside, bringing the shoulder portions of the garment together. The lower portion of the garment can then be folded horizontally over itself several times, making the garment compact enough to be stowed in a typical piece of carry-on luggage. When unpacking the stowed garment, the invention can be hung on a conventional hanger rack or rod unfolded, without having to remove the garment from the hanger.

In general, the foldable hanger of the present invention comprises two pivotally coupled shoulder support members and a hook for hanging the invention on a conventional hanger rack or rod. With the exception of being pivotally attached to each other, the two shoulder support members are similar in size and configuration to the opposite ends of common conventional hangers of the type used to support garments from the shoulder portions or shoulder straps of the garment.

The preferred embodiment of the foldable hanger of the present invention comprises a main body portion, the hook, the two shoulder support members, and a trouser support member. The hook, shoulder support members, and trouser member are all attached to the main body portion for pivoting movement relative to the main body portion. The trouser support member of the garment hanger of the preferred embodiment is generally triangular in shape and is attached only to the top of the main body such that a gap is formed between a vertical edge of the trouser support member and the main body. The gap is open from below to allow a portion of a garment to be passed from beneath the garment hanger upwardly through the opening and into the gap when placing the garment on the shoulder support members. Additionally, the foldable garment hanger of the preferred embodiment is configured such that the shoulder support members and the trouser support member can all be folded to adjacent positions overlapping each other while supporting both trousers and a garment such as a suit coat. As the shoulder support members of the hanger are folded toward each other on opposite sides of the trouser support member, the vertical edge of the trouser support member engages the middle of the garment's backside to hold the middle of the garment adjacent the main body of the hanger, thereby facilitating the folding of the garment suspended on the shoulder support members. Finally, the preferred embodiment of the invention utilizes a hook that is pivotally attached to the main body where it can be used to support the hanger and garments on a conventional hanger rack or rod with the shoulder support members spread apart.

While the principle advantages and features of the present invention have been described above, a more complete and thorough understanding and appreciation for the invention may be attained by referring to the drawings and detailed description of the preferred embodiment, which follow.

BRIEF DESCRIPTION OF THE DRAWINGS

References and characters in the written specification indicate corresponding parts throughout the several views of the drawings.

DETAILED DESCRIPTION OF THE INVENTION

Figure 1:
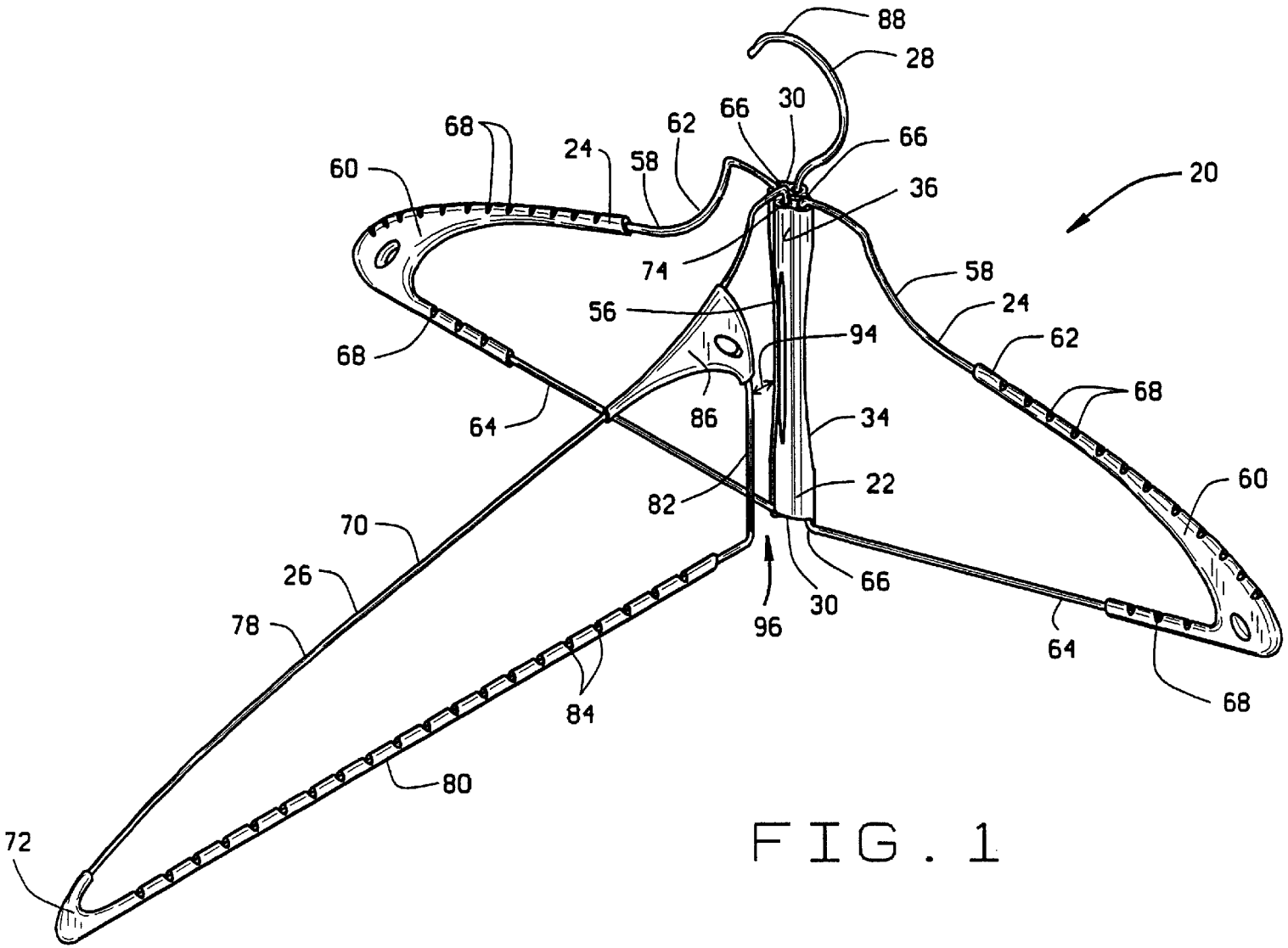
FIG. 1 is an isometric view of a the preferred embodiment of a foldable garment hanger of the invention shown in an unfolded/extended position.

The preferred embodiment of the foldable garment hanger 20 is shown in FIG. 1 in an extended/unfolded position and is generally comprised of a main body 22, two shoulder support members 24, a trouser support member 26, and a hook 28.

Figure 3:
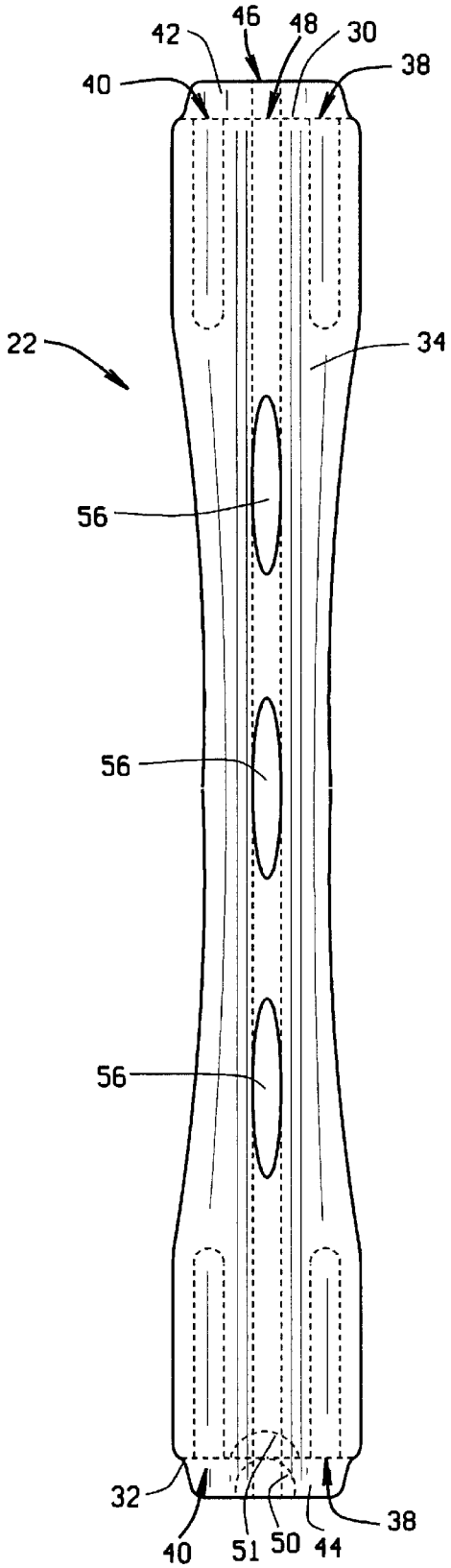
FIG. 3 is a front view of the main body of the preferred embodiment of the invention.
Figure 4:
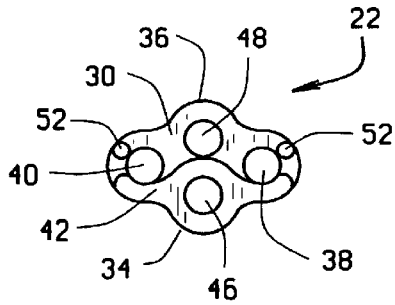
FIG. 4 is a top view of the main body of the preferred embodiment shown in FIG. 3.
Figure 5:
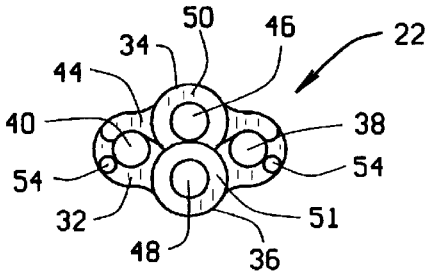
FIG. 5 is a bottom view of the main body of the preferred embodiment shown in FIG. 3.

The main body 22 is preferably formed of a single piece of generally rigid polymeric or acetate resin and serves as a foundation for the other various components of the invention. As shown in FIGS. 3–5, the main body 22 has opposite top 30 and bottom 32 surfaces and opposite front 34 and back 36 portions. A first pair 38 and second pair 40 of blind holes are formed in both the top 30 and bottom 32 surfaces of the main body. Each pair of blind holes comprises a blind hole extending downwardly from the top surface 30 into the main body 22 and a corresponding co-axial blind hole extending upwardly from the bottom surface 32 into the main body. The first 38 and second 40 pairs of blind holes are preferably centered in the main body 22 between the front 34 and back 36 portions of the main body 22 as seen in FIGS. 4 and 5.

The preferred embodiment of the main body 22 also has an upper ridge 42 that projects upwardly from the top surface 30 adjacent the front portion 34 of the main body and a corresponding lower ridge 44 that projects downwardly from the bottom surface 32 adjacent the front portion of the main body. Additionally, a hook hole 46 extends vertically through the main body 22 from the top of the upper ridge 42 to the bottom of the lower ridge 44 adjacent the front portion 34 of the main body. A similar rear hole 48 extends vertically through the main body 22 from the top surface 30 to the bottom surface 32 adjacent the back portion 36 of the main body. Both the hook hole 46 and the rear hole 48 are preferably positioned between the first 38 and second 40 pairs of blind holes and both have semi-spherical countersinks 50, 51 extending upwardly into the main body 22 forming bottom portions of the holes 46,48. In addition to the features described above, the main body 22 preferably has an upper pair of semi-spherical detents 52 extending upwardly from the top surface 30 of the main body and a corresponding lower pair of detents 54 extending downwardly from the bottom surface 32. Finally, a plurality of decorative holes and indentations 56 extend into the main body 22 to enhance the aesthetic appearance of the foldable hanger 20.

Figures 6, 7, 8:
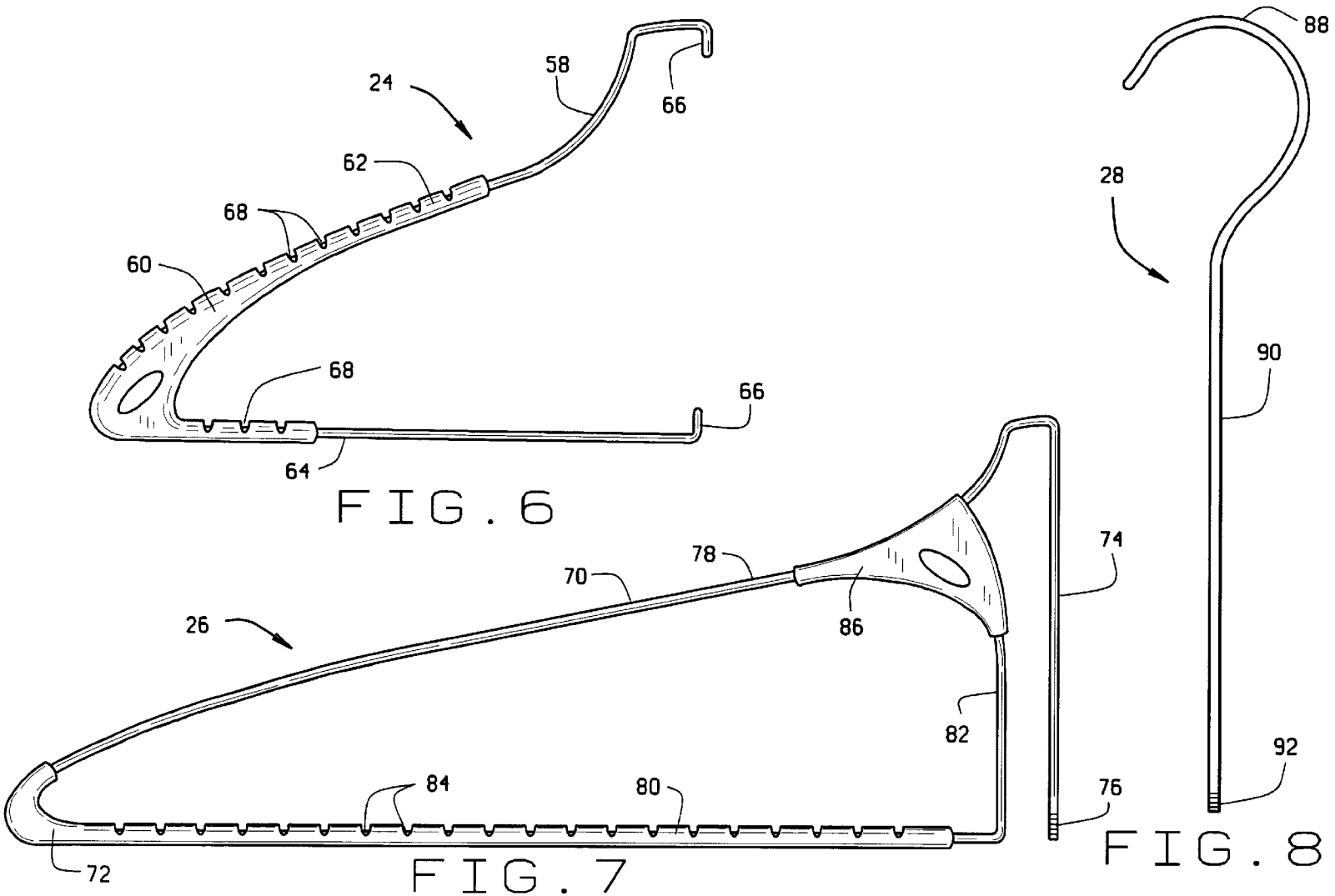
FIG. 6 is a side view of a shoulder support member of the preferred embodiment of the invention.
FIG. 7 is a side view of the trouser support member of the preferred embodiment of the invention.
FIG. 8 is a side view of the hook of the preferred embodiment of the invention.

The preferred embodiment of the foldable hanger 20 comprises two identical shoulder support members 24 as shown in FIG. 6. Each of the shoulder support members 24 is preferably comprised of a structural wire member 58, made of metal or other suitable materials, and a coarse textured cladding 60 molded around a portion of the wire member. The wire member 58 is formed with a curved upper portion 62 and an end turn that turns abruptly to a horizontal lower portion 64. Additionally, the wire member 58 has collinear opposite ends 66 that extend vertically toward each other. The opposite ends each have a length that is less than the depth of the first 38 and second 40 pairs of blind holes in the main body 22. The distance between the opposite ends 66 of the wire member 58 is slightly less than the length of the main body 22 between its top 30 and bottom 32 surfaces. The resilience of the wire member 58 enables the opposite ends 66 to be pulled apart from each other and then to return to their relative positions shown in FIG. 6 when the pulling force is removed. The curved upper portion 62 of each of the shoulder support members 24 is shaped similar to a conventional hanger for supporting a shoulder portion of a garment thereon, and the coarse textured cladding 60 partially encases each of the shoulder support members 24 and functions to prevent garments from sliding off the shoulder support members 24. Additionally, the cladding 60 is preferably formed with a plurality of grooves 68 to further reduce slippage and to enhance the aesthetic appearance of the foldable hanger 20.

The trouser support member 26 of the preferred embodiment, as shown in FIG. 7, is similar in construction to the shoulder support members 24. Like the shoulder support members 24, the trouser support member 26 has a structural wire member 70 and a cladding 72. However, the wire member 70 has only a single free end 74, which extends straight downward and terminates with a threaded portion 76 thereon. The remainder of the wire member 70 preferably extends perpendicularly away from the upper most portion of the free end 74 and then preferably forms a loop comprising a curved upper portion 78 that is connected through an end turn to a horizontal lower portion 80 which is connected through a corner to a vertical portion 82 which intersects the upper portion. The trouser support member 26 is preferably welded or otherwise secured at the intersection of the vertical portion 82 with the upper portion 78 of the wire member to close the loop and prevent undesirable resilient movement of the lower portion 80 of the trouser support member. Unlike the shoulder support members 24 described above, the lower portion 80 of the trouser support member 26, rather than the upper portion 78, is configured to support a garment, in this case trousers. However, like the shoulder support members 24, the trouser support member 26 preferably has a coarse textured cladding 72 with a plurality of grooves 84 encasing a portion of the wire member 70 to prevent the slippage of the garments therefrom. Additionally, the trouser support member 26 preferably has an aesthetically attractive cap 86, formed of material such as that of the cladding 72, that is formed around the intersection of the vertical portion 82 with the upper portion 78 of the trouser support member 26 to conceal the weld described above.

The hook 28 of the preferred embodiment of the foldable hanger 20 is shown in FIG. 8 and is preferably formed of a single piece of wire similar to the wire used to form the shoulder 24 and trouser 26 support members. The hook 28 has an upper end 88 that is preferably shaped similar to a hook on a conventional hanger and is configured to be removeably attached to a conventional hanger rack or rod such as found in a closet for supporting the foldable hanger 20 and garments thereon. Additionally, the hook 28 of the preferred embodiment has an opposite, straight lower end 90 that terminates with a threaded portion 92. The length of the lower end 90 is slightly larger than the length of the main body 22 between its upper 42 and lower 44 ridges.

As mentioned above, the various components of the preferred embodiment of the foldable hanger 20 are united by the main body 22 as shown in FIG. 1. To pivotally attach the shoulder support members 24 to the main body 22, the opposite ends 66 of one of the shoulder support members 24 are resiliently deflected away from each other until the top 30 and bottom 30 surfaces of the main body can be positioned between the opposite ends of the shoulder support member. The opposite ends 66 of the shoulder support member 24 are then aligned with the first pair of blind holes 38 and allowed to resiliently move toward each other into the first pair of blind holes. The other shoulder support member 24 is attached to the main body 22 in a similar manner but in the second pair of blind holes 40. It is important to note that the main body 22 is configured such that the distance between the top surface 30 and the bottom surface 32 of the main body prevents the opposite ends 66 of the shoulder support members 24 from completely returning to their relative undeflected positions such that the upper 62 and lower 64 portions of the shoulder support members 24 exert a residual compression force on the top and bottom surfaces of the main body.

In the preferred embodiment, the trouser support member 26 is pivotally attached to the main body 22 by passing the straight, free end 74 of the trouser support member through the rear hole 48 of the main body from above the main body. A standard ball nut (not shown) is then threaded onto the threaded portion 76 of the free end 74 of the trouser support member 26 from below the main body 22. Once assembled, the ball nut engages the semispherical countersink 51 of the rear hole 48 of the main body 22 to prevent the removal of the trouser support member 26 from the main body. When the trouser support member 26 is attached to the main body 22 as shown in FIG. 1, a gap 94 is formed between the vertical portion 82 of the trouser support member 26 and the back portion 36 of the main body 22. An opening 96 at the bottom of the gap 94 is configured to allow a portion of a garment to be passed up through the opening and into the gap from beneath the foldable hanger 20.

Finally, the hook 28 of the preferred embodiment is pivotally attached to the main body 22 in a manner similar to the trouser support member 26. The lower, straight end 90 of the hook is inserted through the hook hole 46 of the main body from above, and a ball nut (not shown) is threaded onto the threaded portion 92 of the lower end of the hook. Like the assembly of the trouser support member 26, once assembled, the ball nut engages the semispherical countersink 50 of the hook hole 46 to prevent removal of the hook 28 from the main body 22.

Figure 2:
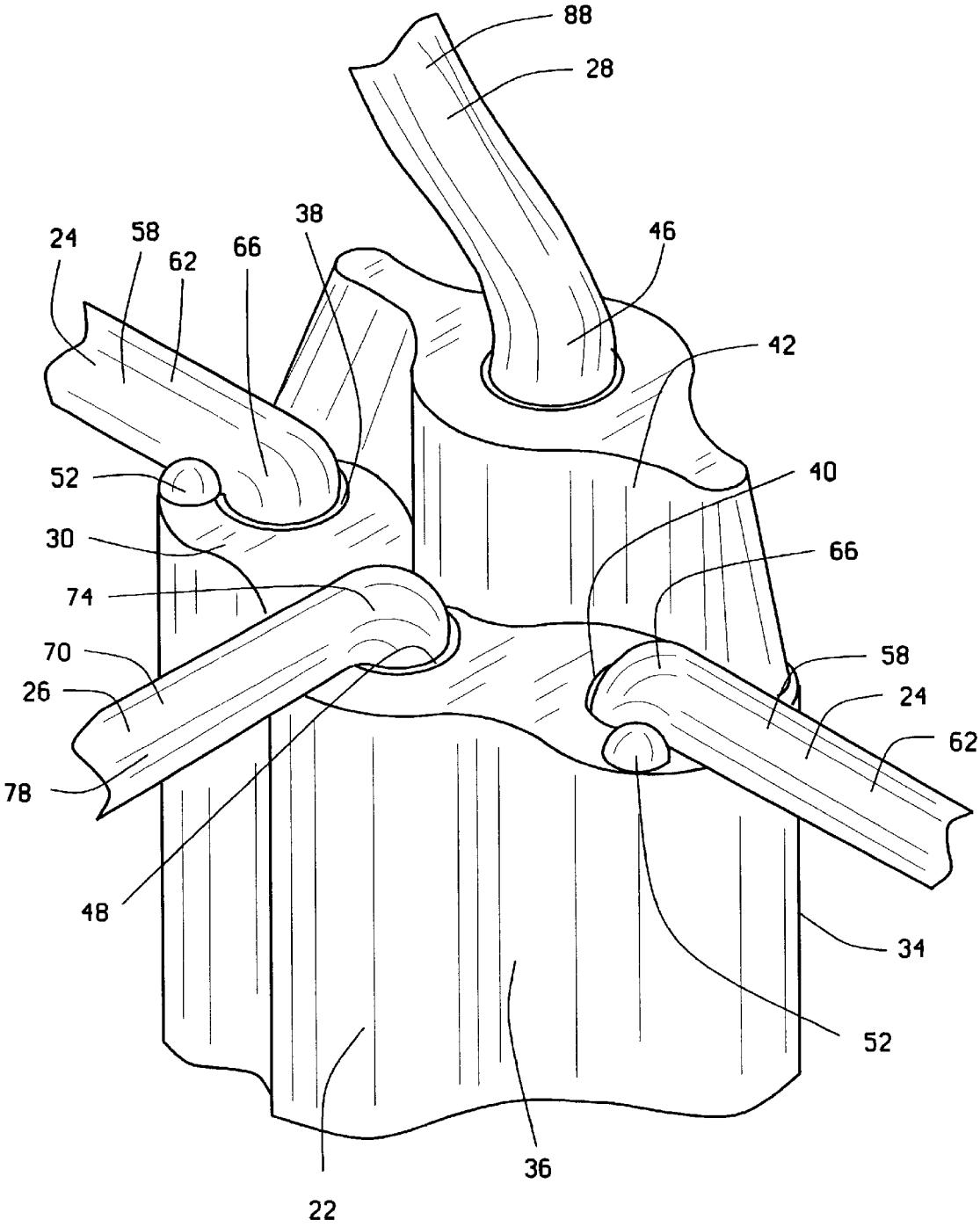
FIG. 2 is a detailed partial view of the foldable garment hanger as shown in FIG. 1, showing the top of the main body.

When the foldable hanger 20 of the preferred embodiment is assembled as described above, the shoulder support members 24 can be pivoted about the vertical axis of the main body 22 to an open position where they extend in generally opposite directions from each other, as shown in FIGS. 1 and 2. In this unfolded/extended position, the upper portion 62 of each of the shoulder support members 24 rest between the upper pair of detents 52 and the upper ridge 42 of the main body 22. Likewise, the lower portion 64 of each of the shoulder support members 24 rest between the lower pair of detents 54 and the lower ridge 44 of the main body 22. As shown in the detailed view of FIG. 2, the upper 42 and lower 44 ridges are positioned on the main body 22 where they will prevent the shoulder support members 24 from rotating about the main body past the unfolded/extended position toward the front portion 34 of the main body. Additionally, the upper 52 and lower 54 pairs of detents are positioned on the main body 22 where they prevent the shoulder support members 24 from freely rotating towards the back portion 36 of the main body without exerting a force sufficient to deflect the opposite ends 66 of each of the shoulder support members away from each other so as to allow the shoulder support members to pass over the upper and lower pairs of detents. Thus when the foldable hanger 20 of the preferred embodiment is extended/unfolded, a suit coat or other garment can be placed on the foldable hanger by positioning a portion of the garment in the gap 94 between the main body 22 and the trouser support member 26, with the backside of the garment facing away from the main body and with the shoulder portions of the garment supported on the shoulder support members 24 in a conventional manner. Alternatively, the garment can be hung over the shoulder support members 24 on the opposite side of the main body 22 from the trouser support member 26. The hook 28 can then be used to suspend the garment from a standard hanger pole or rod. Additionally, trousers can simultaneously be placed on the lower portion 30 of the trouser support member 26 and supported thereon in a conventional manner.

Figure 9:
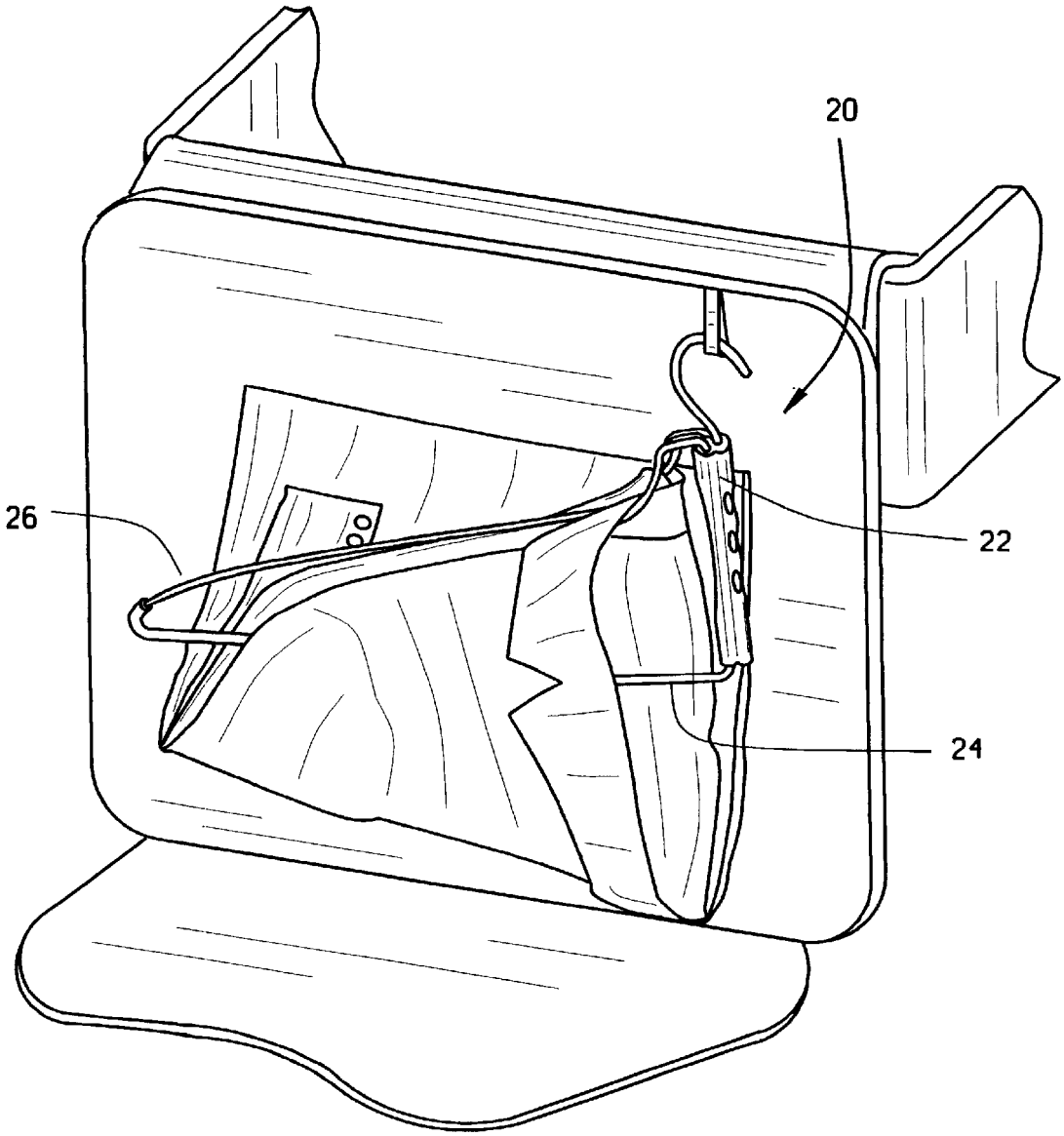
FIG. 9 is an isometric view of the preferred embodiment of the invention shown supporting a suit coat in a folded manner against an inner compartment of a piece carry-on luggage.

When desired, the invention can be used to compactly fold the garments supported on the hanger 20 for traveling. In the preferred embodiment, this is done by folding the shoulder support members 24 of the foldable hanger 20 toward each other by exerting a force sufficient to pass the shoulder support members over the upper and lower 54 pairs of detents extending from the main body 22 as described above. When doing so, the vertical portion 82 of the trouser support member 26 engages the backside of the garment supported on the shoulder support members 24 and acts to facilitate folding the garment in half about the centerline of the backside of the garment. When the foldable hanger 20 is completely folded, the shoulder portions of the garment are adjacent to each other with the trouser support member 26, and any trousers, suspended thereon therebetween. The lower portion of the garment supported on the shoulder support members 24 and any trousers supported on the trouser support member 26 can then be folded horizontally upward one or two times as required to further reduce the dimensions of the folded garments such that they may be placed within a standard piece of carry-on luggage as shown in FIG. 9.

In conjunction with the invention, an optional garment sleeve (not shown) specifically configured for use with a foldable hanger of the invention can be placed over the garments to protect the garments when traveling. The garment sleeve is similar to conventional garment sleeves or bags which are configured to drape over a garment on a hanger and which have an opening through which hanger hooks can be extended. Unlike conventional prior are garment sleeves that generally slope down towards opposite vertical sides from the centrally positioned hook opening at the top of the garment sleeve, the sleeve preferably used with the invention has a hook opening positioned adjacent the top of one vertical side of the garment sleeve and slopes downward toward an opposite vertical side of the sleeve to accommodate a garment supported on a folded hanger in accordance with the invention. Additionally, the garment sleeve preferably used with the invention has a rectangular, semi-rigid backing sheet attached adjacent a lower portion of the garment sleeve that can be utilized to facilitate folding of the lower portions of the garments horizontally upward. The backing sheet also acts to prevent such garments from moving within luggage when traveling.

Although the invention has been described above in reference to the preferred embodiment, it should be understood that the invention is not limited to these embodiments and numerous alternative embodiments or changes to these embodiments could be made without departing from the scope of the invention. As an example, in an alternative embodiment the trouser support member could be formed as an integral protrusion of the main body or could even be eliminated altogether. Additionally, neither the trouser support member nor the hook need be pivotally attached to the main body. In yet another alternative embodiment, one skilled in the art could fashion a foldable hanger in accordance with the invention wherein the various components of such a hanger are directly attached to each other without utilizing a main body or separate foundation. Furthermore, various configurations of shoulder support members and trouser support members are known in the art and various configurations and materials could be used in place of those described above. Likewise, various components could be pivotally attached by numerous means known in the art such as by using flexible material in place of articulating joints.

Thus it should be clear that modifications and variations of the invention could be made without departing from the scope of the invention which should be considered as being limited only by the scope of the claims and their equivalents.

What is claimed:

1. A garment hanger comprising:

two shoulder support members adapted for supporting a garment thereon, each of the shoulder support members having a pivot end and a distal end opposite the pivot end, the two shoulder support members being selectively pivotable at their pivot ends between open and folded positions relative to each other, each of the shoulder support members extending from its pivot end to its distal end in a direction generally opposite the other shoulder support member when the shoulder support members are in the open position and each of the shoulder support members extending from its pivot end to its distal end in a direction side-by-side with the other shoulder support member when the shoulder support members are in the folded position, the two shoulder support members being adapted to support a garment thereon when in the open position and also when in the folded position;

a main body upon which each of the two shoulder support members are pivotally attached, each of the shoulder support members being pivotal about separate parallel axes; and a hook pivotally attached to both of the two shoulder support members, the hook being adapted to support the garment hanger on a separate horizontally oriented hanger rod when the shoulder support members are in the open position and a garment is supported thereon.

2. The garment hanger of claim 1, wherein:

the hook is pivotally attached to the main body.

3. The garment hanger of claim 1, further comprising:

a locking mechanism adapted to restrain the shoulder support members from pivoting toward each other when the shoulder support members are in the open position.

4. The garment hanger of claim 1, further comprising:

a trouser support member adapted for supporting a garment thereon, the trouser support member being attached to the main body where the trouser support member will be positioned between the two shoulder support members when the shoulder support members are in the folded position.

5. A garment hanger comprising:

two shoulder support members adapted for supporting a garment thereon, the two shoulder support members being selectively pivotable between open and folded positions relative to each other, the shoulder support members extending in generally opposite directions from each other when in the open position and being adjacent to each other when in the folded position, the two shoulder support members being adapted to support a garment thereon when in the open position and also when in the folded position;

a main body upon which each of the two shoulder support members are pivotally attached, each of the shoulder support members being pivotal about separate parallel axes;

a hook attached to the two shoulder support members, the hook being adapted to support the garment hanger on a separate horizontally oriented hanger rod when the shoulder support members are in the open position and a garment is supported thereon; and a trouser support member adapted for supporting a garment thereon, the trouser support member being pivotally attached to the main body for pivoting about an axis that is parallel to the axes about which the shoulder support members pivot and being attached to the main body where the trouser support member will be positioned between the two shoulder support members when the shoulder support members are in the folded position.

6. A garment hanger comprising:

two shoulder support members adapted for supporting a garment thereon, the two shoulder support members being selectively pivotable between open and folded positions relative to each other, the shoulder support members extending in generally opposite directions from each other when in the open position and being adjacent to each other when in the folded position, the two shoulder support members being adapted to support a garment thereon when in the open position and also when in the folded position;

a main body upon which each of the two shoulder support members are pivotally attached, each of the shoulder support members being pivotal about separate parallel axes;

a hook attached to the two shoulder support members, the hook being adapted to support the garment hanger on a separate horizontally oriented hanger rod when the shoulder support members are in the open position and a garment is supported thereon; and a trouser support member adapted for supporting a garment thereon, the trouser support member being attached to the main body where the trouser support member will be positioned between the two shoulder support members when the shoulder support members are in the folded position, the trouser support member also being attached to the main body such that a gap extends between the main body and the trouser support member, the gap having an opening that opens downward to allow a portion of a garment to be passed from beneath the garment hanger upwardly through the opening and into the gap when positioning such a garment on the shoulder support members.

7. The garment hanger of claim 6, wherein:

the trouser support member has a vertically oriented portion adjacent the gap between the trouser support member and the main body, the vertically oriented portion being positioned relative to the shoulder support members where the vertically oriented portion will engage with a garment supported on the shoulder support members and facilitate the folding of such a garment when such a garment is supported on the shoulder support members and the shoulder support members are pivoted from the open position to the folded position.

8. A garment hanger comprising:

two shoulder support members adapted for supporting a garment thereon, each of the shoulder support members having a pivot end and a distal end opposite the pivot end, the two shoulder support members being selectively pivotable at their pivot ends between open and folded positions relative to each other, each of the shoulder support members extending from its pivot end to its distal end in a direction generally opposite the other shoulder support member when the shoulder support members are in the open position and each of the shoulder support members extending from its pivot end to its distal end in a direction side-by-side with the other shoulder support member when the shoulder support members are in the folded position, the two shoulder support members being adapted to support a garment thereon when in the open position and also when in the folded position; and a trouser support member adapted for supporting a garment thereon, the trouser support member being pivotally attached to at least one of the two shoulder support members where the trouser support member will be positioned substantially between the two shoulder support members when the shoulder support members are in the folded position.

9. The garment hanger of claim 8, further comprising:

a hook attached to the two shoulder support members, the hook being adapted to support the garment hanger on a separate horizontally oriented hanger rod when the shoulder support members are in the open position and a garment is supported thereon.

10. The garment hanger of claim 8, further comprising:

a locking mechanism adapted to restrain the shoulder support members from pivoting toward each other when the shoulder support members are in the open position.

11. The garment hanger of claim 8, further comprising:

a main body upon which at least two of the trouser support member and the two shoulder support members are pivotally attached.

12. The garment hanger of claim 11, wherein:

the trouser support member is attached to the main body such that a gap extends between the main body and the trouser support member, the gap having an opening that opens downward to allow a portion of a garment to be passed from beneath the garment hanger upwardly through the opening and into the gap when positioning such a garment on the shoulder support members.

13. The garment hanger of claim 12, wherein:

the trouser support member has a vertically oriented portion adjacent the gap between the trouser support member and the main body, the vertically oriented portion being positioned relative to the shoulder support members where the vertically oriented portion will engage with a garment supported on the shoulder support members and facilitate the folding of such a garment when such a garment is supported on the shoulder support members and the shoulder support members are pivoted from the open position to the folded position.

14. A garment hanger comprising:

two shoulder support members adapted for supporting a garment thereon, the two shoulder support members being selectively pivotable between open and folded positions relative to each other, the shoulder support members extending in generally opposite directions from each other when in the open position and being adjacent to each other when in the folded position, the two shoulder support members being adapted to support a garment thereon when in the open position and also when in the folded position;

a positive locking mechanism adapted to restrain the shoulder support members from pivoting toward each other when the shoulder support members are in the open position; and a main body upon which each of the two shoulder support members are pivotally attached, each of the shoulder support members being pivotal about separate parallel axes.

15. A garment hanger comprising:

two shoulder support members adapted for supporting a garment thereon, the two shoulder support members being selectively pivotable between open and folded positions relative to each other, the shoulder support members extending in generally opposite directions from each other when in the open position and being adjacent to each other when in the folded position, the two shoulder support members being adapted to support a garment thereon when in the open position and also when in the folded position;

a main body upon which each of the two shoulder support members are pivotally attached, each of the shoulder support members being pivotal about separate parallel axes, each of the two shoulder support members has a pair of coaxial free ends that are resiliently biased toward each other and that are positioned within holes extending into opposite sides of the main body so as to allow the shoulder support member to pivot relative to the main body, a resilience of each shoulder support members holding the freed ends of each shoulder support member in the holes of the main body and the main body preventing the free ends from moving toward each other; and a locking mechanism adapted to restrain the shoulder support members from pivoting toward each other when the shoulder support members are in the open position, the locking mechanism including at least one protrusion positioned on at least one of the opposite sides of the main body where the free ends of each shoulder support member must pass over the protrusion when the two shoulder members are pivoted from the open position to the folded position.

16. A garment hanger comprising:

two shoulder support members adapted for supporting a garment thereon, the two shoulder support members being selectively pivotable between open and folded positions relative to each other, the shoulder support members extending in generally opposite directions from each other when in the open position and being adjacent to each other when in the folded position, the two shoulder support members being adapted to support a garment thereon when in the open position and also when in the folded position;

a positive locking mechanism adapted to restrain the shoulder support members from pivoting toward each other when the shoulder support members are in the open position; and a trouser support member adapted for supporting a garment thereon, the trouser support member is pivotally attached to at least one of the two shoulder support members where the trouser support member will be positioned substantially between the two shoulder support members when the shoulder support members are in the folded position.

17. The garment hanger of claim 16, wherein:

the trouser support member has a vertically oriented portion that is positioned relative to the shoulder support members where it will engage with a garment supported on the shoulder support members and facilitate the folding of such a garment when such a garment is supported on the shoulder support members and the shoulder support members are pivoted from the open position to the folded position.

* * * * *